US006396235B1

(12) United States Patent
Ellington et al.

(10) Patent No.: US 6,396,235 B1
(45) Date of Patent: May 28, 2002

(54) STABILIZED COMMON GIMBAL

(75) Inventors: Thomas W. Ellington, Alton, IL (US); Bruce E. Exely, St. Louis, MO (US); Jeffrey S. Folmer, Collinsville, IL (US); William S. Lambros, Bridgeton, MO (US); Thomas D. Linton, Lake St. Louis, MO (US); John P. Buck, Jr.; Russell R. Moning, both of St. Louis, MO (US); Peter M. Ellis, Warson Woods, MO (US); Kenneth A. Roseman; James R. Marshall, both of Chesterfield, MO (US)

(73) Assignee: Engineered Support Systems, Inc., St. Louis, MO (US)

( * ) Notice: Subject to any disclaimer, the term of this patent is extended or adjusted under 35 U.S.C. 154(b) by 0 days.

(21) Appl. No.: 09/755,819

(22) Filed: Jan. 5, 2001

(51) Int. Cl.[7] ..... G01C 19/48; G01C 19/54

(52) U.S. Cl. ..... 318/649; 33/321; 74/5.34

(58) Field of Search ..... 318/648, 649, 318/668; 33/318, 321; 74/5 R, 5.34, 5.4

(56) References Cited

U.S. PATENT DOCUMENTS 3,599,495 A * 8/1971 Brown et al.
3,762,226 A * 10/1973 Davis et al.
3,775,656 A * 11/1973 Romans ..... 418/648
3,813,788 A * 6/1974 Johnston
4,180,916 A * 1/1980 Brook
4,442,723 A * 4/1984 Auer
4,800,501 A * 1/1989 Kinsky
4,828,376 A * 5/1989 Padera

* cited by examiner

*Primary Examiner*—Bentsu Ro
(74) *Attorney, Agent, or Firm*—Polster, Lieder, Woodruff & Lucchesi, L.C.

(57) ABSTRACT

A two axis (azimuth and elevation) stabilized common gimbal (SGC) for use on a wide variety of commercial vehicles and military vehicles which are employed in combat situations capable of stabilizing a payload of primary sensors and of mounting a secondary sensor payload that is independent of the moving axes. The SCG employs three gyroscopes, inertial angular rate feedback for providing gimbal control of two axes during slewing and stabilization. In addition the third (roll) gyroscope is used for performing automatic calibration and decoupling procedures. In this regard, the SCG provides an interface for the primary suite of sensors comprising one or more sensors having a common line-of-sight (LOS) and which are stabilized by electronics, actuators, and inertial sensors against vehicle motion in both azimuth and elevation. Remote positioning of the LOS of sensors in the primary suite is also accomplished, with the SCG providing an inertial navigation system (INS) which provides navigation and which detects the LOS for the primary suite of sensors relative to the vehicle.

The aforementioned stabilized gimbal employs unique features such as automotive gyro calibration and decoupling algorithm that increases the producibility of the system and the stabilized gimbal has the capability of being remotely controlled via its system serial link where commands may originate from devices such as radio links or target trackers.

15 Claims, 10 Drawing Sheets

STABILIZED COMMON GIMBAL

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to gimbal systems, and more particularly, to a stabilized common gimbal (SCG) for use on commercial vehicles and on military vehicles employed in battlefield environments. The SCG of the present invention is usable with a variety of sensor suites such as are used on different military vehicles and is particularly advantageous over a conventional manual adjustment gimbal systems in that the remote operation of the SGC does not unduly expose a vehicle crew to danger in combat situations by requiring a crew member to exit the vehicle to perform manual adjustments.

Heretofore, gimbal systems have been built for use either with a particular set of sensors, or for use on a specific vehicle. Accordingly, it is currently impossible to use a gimbal system interchangeably on a variety of vehicles, or to swap out one sensor or set of sensors with another. This has obvious ramifications when it comes to the amount of inventory necessary to cover possible operational contingencies, the amount of training required for service personnel having to install and maintain a variety of different systems, as well as for vehicle personnel who need to know and understand the nuances of each gimbal system they may be required to use.

With regard to gimbal systems employed on combat vehicles, such vehicles, by their nature, are expected to operate over a wide variety of terrain and move through numerous positions as they traverse a battlefield. Modem military vehicles are equipped with a variety of sensors enabling them to locate and identify other forces moving over the same terrain. To properly function, it is desirable that the platform on which these sensors are mounted remain inertially stable regardless of the vehicle's gyrations. Heretofore, maintaining a stable platform has required manual operations performed by the crew. Since the crew is subject to the same lurching as the vehicle and is exposed to enemy fire, their ability to manually maintain a stable platform has not always been optimum. In addition, the crew's activities in trying to stabilize the sensor platform has exposed the crew to substantial risk. Accordingly, there is a need for a common gimbal system which automatically provides a stable platform for a variety of sensors, and which reduces the risk to the crew from exposure to enemy fire.

BRIEF SUMMARY OF THE INVENTION

Briefly stated, the present invention provides a stabilized common gimbal. The term "common" is used because the same stabilized gimbal system can be installed on a wide variety of commercial vehicles and military vehicles, the latter of which are employed in combat situations. It is a feature of the present invention that the SCG is interchangeably usable with a wide variety of sensors or sensor packages or sensor suites and that the SCG regardless of the sensors installed on it can automatically stabilize a sensor package to a particular line-of-sight (LOS).

The SCG of the present invention is a two axis (azimuth and elevation) gimbal capable of stabilizing a payload of primary sensors weighing nominally one hundred pounds (45.5 kg) to an average positional accuracy of 25 $\mu$rad. The SCG further is capable of mounting a secondary sensor payload of nominally fifty pounds (22.7 kg) that is independent of the moving axes of the gimbal. The primary and secondary sensor payloads are environmentally protected. The SCG employs three gyroscopes which are respectively used to detect inertial rates in the azimuth axis, the elevation axis, and the roll axis. The inertial rate information provided by the gyroscopes is utilized by a gimbal control during slewing of a sensor payload and its stabilization. Even though there is no controlled roll axis in the two axis system provided, the roll gyroscope is used for decoupling the azimuth and elevational axes. Further, the roll gyroscope assists in an automatic calibration procedure that reduces mechanical design tolerances, making a Gyroscope Assembly Unit (GAU) of the SCG more economical to produce.

The SCG provides an interface for a primary suite of sensors comprising one or more sensors having a common line-of-sight (LOS) and which are stabilized in both azimuth and elevation. An inertial navigation system (INS) provides navigation and measures the LOS for the primary suite of sensors relative to inertial space. An Axis Control Unit (ACU) is provided which incorporates hardware and software that provides motor drives, an interface for gimbal motion sensors, an interface to system communications, and control loop closure. The SCG provides electronics, actuators, resolvers, and inertial sensors for stabilizing the LOS of the primary suite of sensors against vehicle motion or other disturbances (e.g. wind loads). Remote positioning of the LOS of sensors in the primary suite is also accomplished. The remote commands can originate from an operator's Common Control Panel (CCP) joystick or from commands over the system's serial interface. System serial interface commands may originate from a tracker in the local system or from commands over any appropriate communication link, such as a radio. The SCG further provides an interface for a secondary suite of sensors again comprising one or more sensors. This second suite of sensors is not stabilized and has a base platform independent from the primary suite of sensors. Finally, the SCG includes an inherent capability for boresighting the sensors comprising the primary suite of sensors, and for retaining the boresight thereafter. The SCG has a signature which is minimized in the visible, radio-frequency (RF), and infrared (IR) portions of the spectrum.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

In the drawings.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1A:
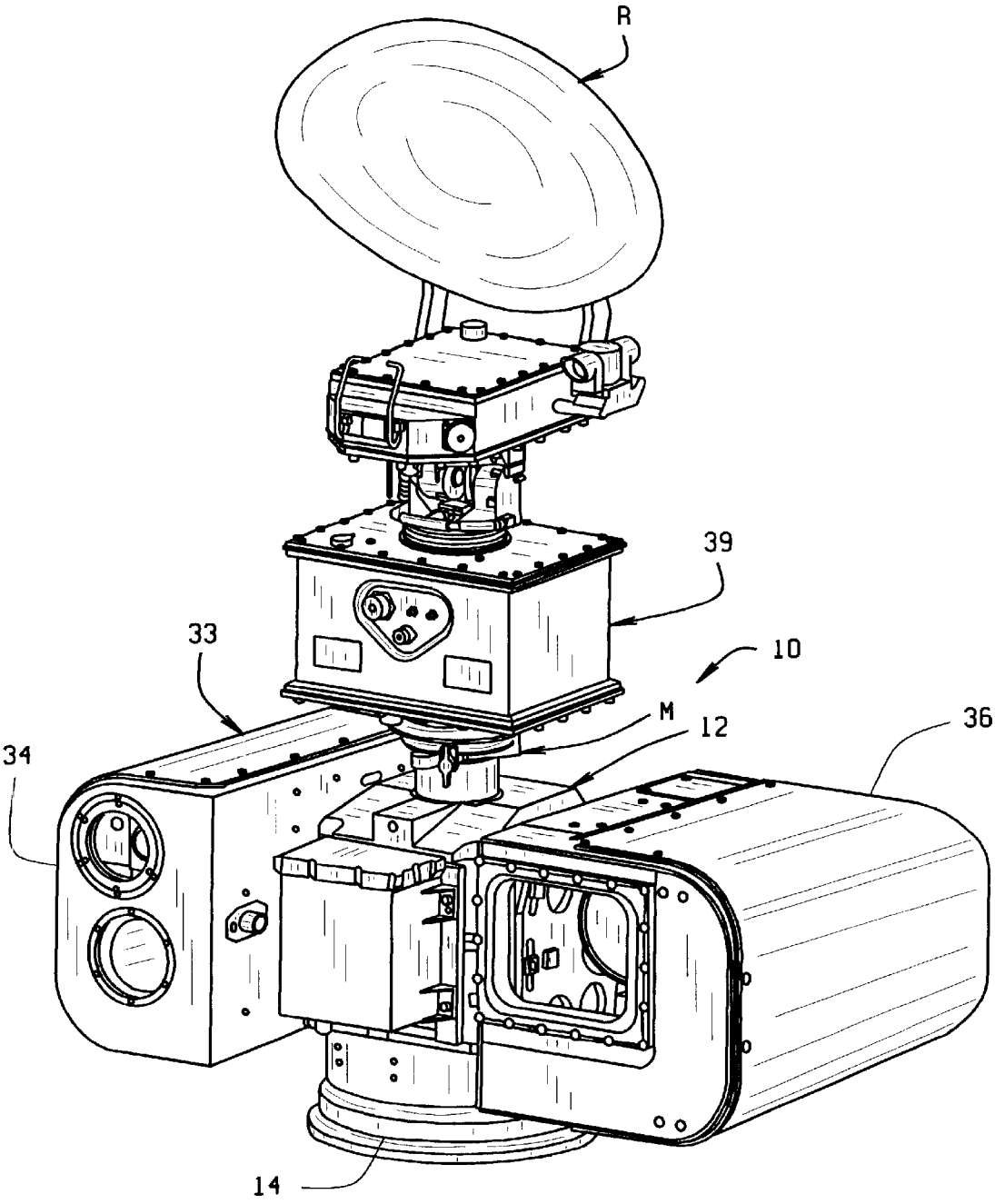
FIG. 1A is a perspective view of the stabilized common gimbal of the present invention with ancillary equipment such as a radar and FLIR mounted to the gimbal.
Figure 1B:
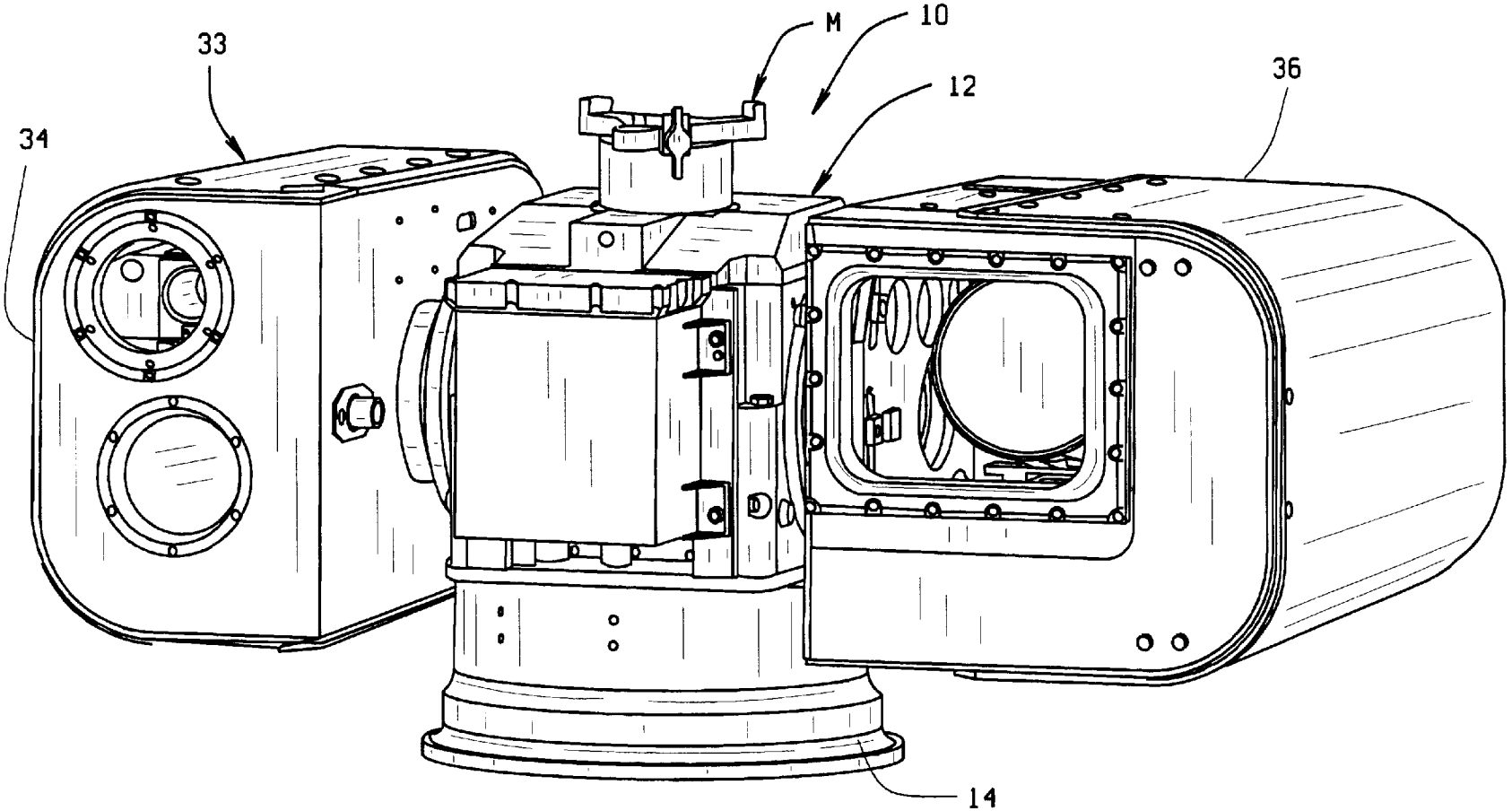
FIG. 1B is a similar view with the radar removed.

Referring to FIGS. 1A and 1B, a stabilized common gimbal (SCG) of the present invention is indicated generally at 10. As is described herein, the SCG 10 is a two-axis (elevation and azimuth) gimbal consisting of an azimuth housing 12, rotationally secured to a mounting flange 14 for attachment to a vehicle, a mast, or other support structure (all not shown) and an elevation housing 16 fitted to azimuth housing 12. Azimuth housing 12 provides for rotational movement within a predetermined range about an azimuth axis, while elevation housing 16 provides for independent rotational movement within a predetermined range about an elevation axis.

Figure 2A:
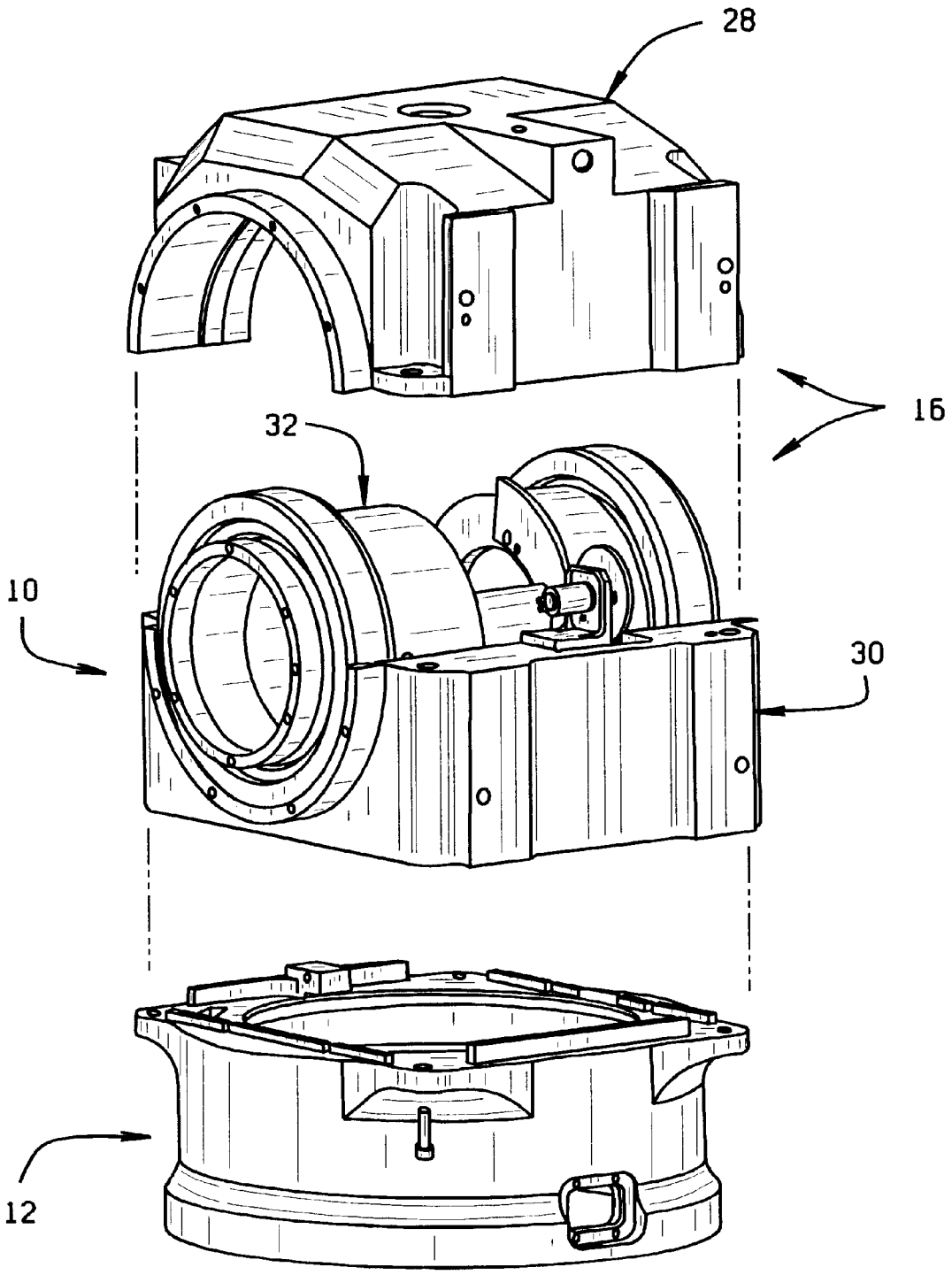
FIG. 2A is a simplified exploded perspective view of the housing components of the stabilized common gimbal of the present invention.
Figure 2B:
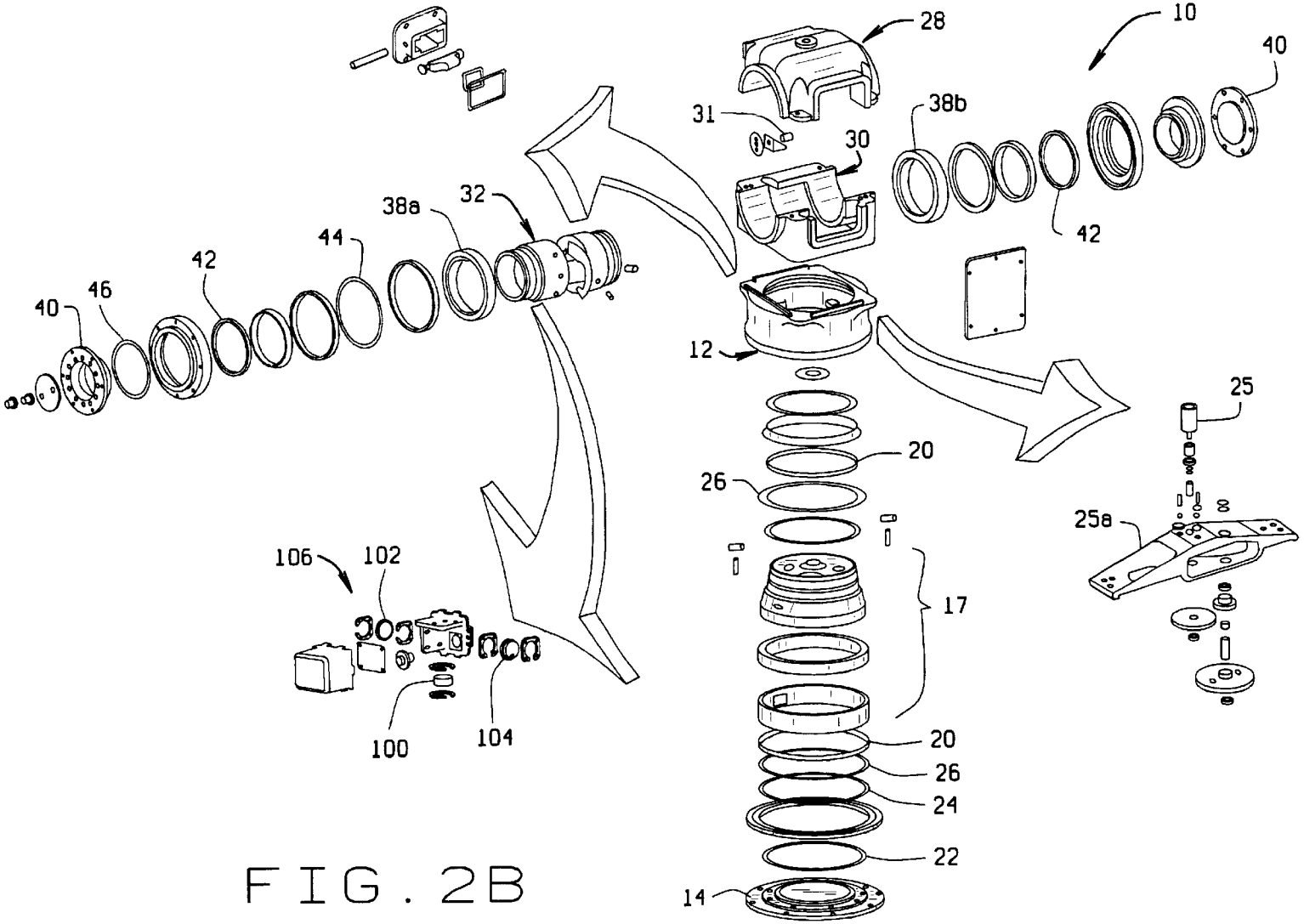
FIG. 2B is a detailed exploded perspective view of the components of the stabilized common gimbal of the present invention.

As seen in FIGS. 2A and 2B, azimuth housing 12 incorporates an axially mounted azimuth drive ring motor 17, an axially mounted azimuth rotational shaft driven by the ring motor, and a number of associated bearings 20, o-ring type seals 22, washers 24, and wave springs 26, as best seen in FIG. 2B, to stabilize azimuth housing 12 against vehicle motion. During operation, azimuth drive ring motor 17 rotates azimuth housing 12 about a vertical axis relative to mounting flange 14, thereby providing the first axis of rotation (azimuth) for SGC 10. Rotation of the azimuth housing about the first axis of rotation (azimuth) of the SGC causes the elevation housing to rotate together therewith, and this rotation is measured by a brushless azimuth resolver 25 secured to the azimuth housing by a suitable mounting bracket 25*a*. An azimuth hard stop assembly within housing 12 prevents the azimuth housing from rotating outside of a predetermined range (which is preferably ±250° about a nominal zero position) by providing a block or striker which engages a pair of striker pawls secured to the azimuth rotational shaft driven by ring motor 17.

Elevation housing 16 consists of an upper housing 28 and a lower housing 30. The elevation housing contains the components of an elevation shaft or gimbal 32. The gimbal extends from the left and right sides of the elevation housing 16 to provide a mounting structure for a primary sensor payload 33 such as shown in FIGS. 1A and 1B. The weight of this payload can be up to 100 pounds (45.5 kg) depending on the weight distribution. Payloads greater than 100 pounds can be accommodated by the gimbal, but with a degradation in stabilization performance. Further, the primary sensor payload may be divided into a left sensor pod 36 and a right sensor pod 34, each containing a primary suite of sensors as more fully described hereinafter. To drive gimbal 32 within a predetermined arcuate range (preferably ±45°), a pair of axially mounted elevation drive ring motors 38A and 38B are fitted within elevation shaft 32, together with associated electronics and housings for the stabilizing gyroscopes, as is more fully explained below. On each end of elevation shaft or gimbal 32, extending beyond elevation housing 16, is a mounting flange 40. These flanges are suitably sealed by a combination of bearings 42, wave springs 44, and o-ring type seals 46. Those of ordinary skill in the art will recognize that the specific configuration of each mounting flange 40 may be adapted to conform to the mounting requirements of the primary sensor payload pods 34, 36 mounted thereto. Accordingly, the left and right ends of gimbal 32 need not be identically configured. During operation, drive ring motors 38A, 38B rotate elevation shaft 32 about a horizontal axis relative to azimuth housing 12, thereby providing the second axis of rotation (elevation) for SGC 10. The amount of this rotation is measured by a brushless elevation resolver 31 mounted to lower elevation housing 30. In addition to supporting the primary suite of sensors on elevation shaft or gimbal 32, SCG 10 is also capable of supporting an optional secondary payload 39 which is mounted to upper housing 28 of elevation housing 16. This secondary payload 39, which can weigh up to 50 pounds (22.7 kg), comprises a secondary suite of sensors which operate independently of the moving axes of SGC 10. Any motion and/or control of this secondary sensor payload is provided by systems embedded in the secondary suite of sensors, and this allows the sensors of the secondary suite to function independently of the primary line of sight (LOS) utilized by the primary sensor payload. In FIG. 1A, an MSTAR tripod mount M is secured to upper housing 28 to provide the mounting surface for the secondary payload which includes, for example, a MSTAR Doppler Radar unit R. It is a feature of the invention that the SCG is capable of taking long range sensor data; for example, returns from radar unit R, and slewing the primary suite of sensors to a LOS dictated by the long range sensor data. This is done to assist in shorter visual range identification of an object of interest.

The SGC preferably provides nominal performance tracking of 100 $\mu$rad/second and meets a nominal stabilization requirement of 25 $\mu$rad. To achieve these performance and stabilization requirements, accurate rate of movement feedback is provided by three separate gyroscopes, 100 and 102, for independent azimuth and elevation control, and a third, roll, gyroscope 104 which is used to facilitate an auto calibration procedure. A gyro assembly unit (GAU) 106 houses the gyroscopes 100, 102, and 104, which are mounted in quadrature within the unit. Also housed within the GAU is the associated electronics required to convert rate inputs from the gyroscopes and serially communicate this information to an external Axes Control Unit (ACU) 108 which contains the hardware and software that controls SCG 10.

Figure 3A:
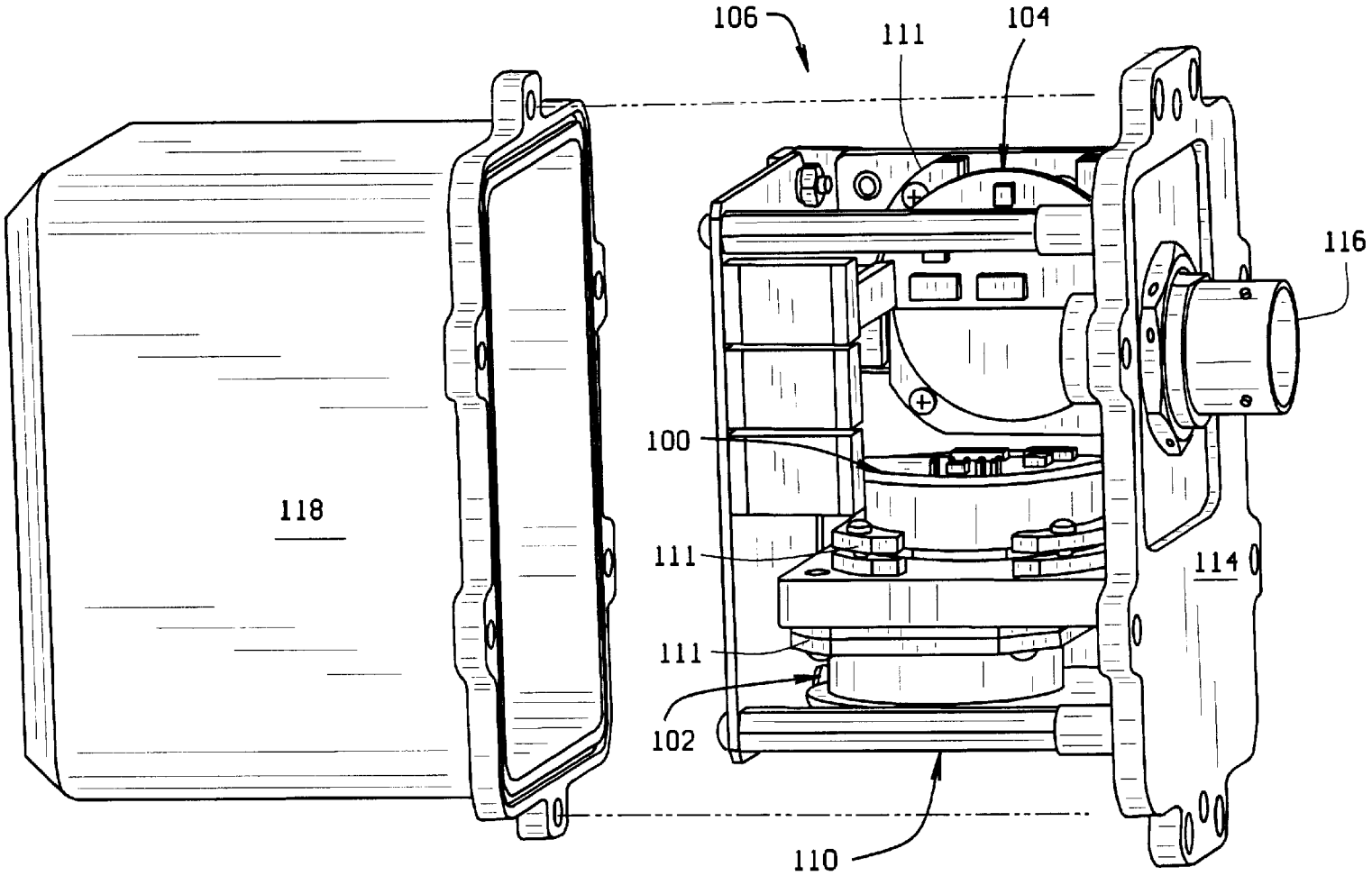
FIG. 3A is a perspective view of the gyroscope assembly component of the stabilized common gimbal.
Figure 3B:
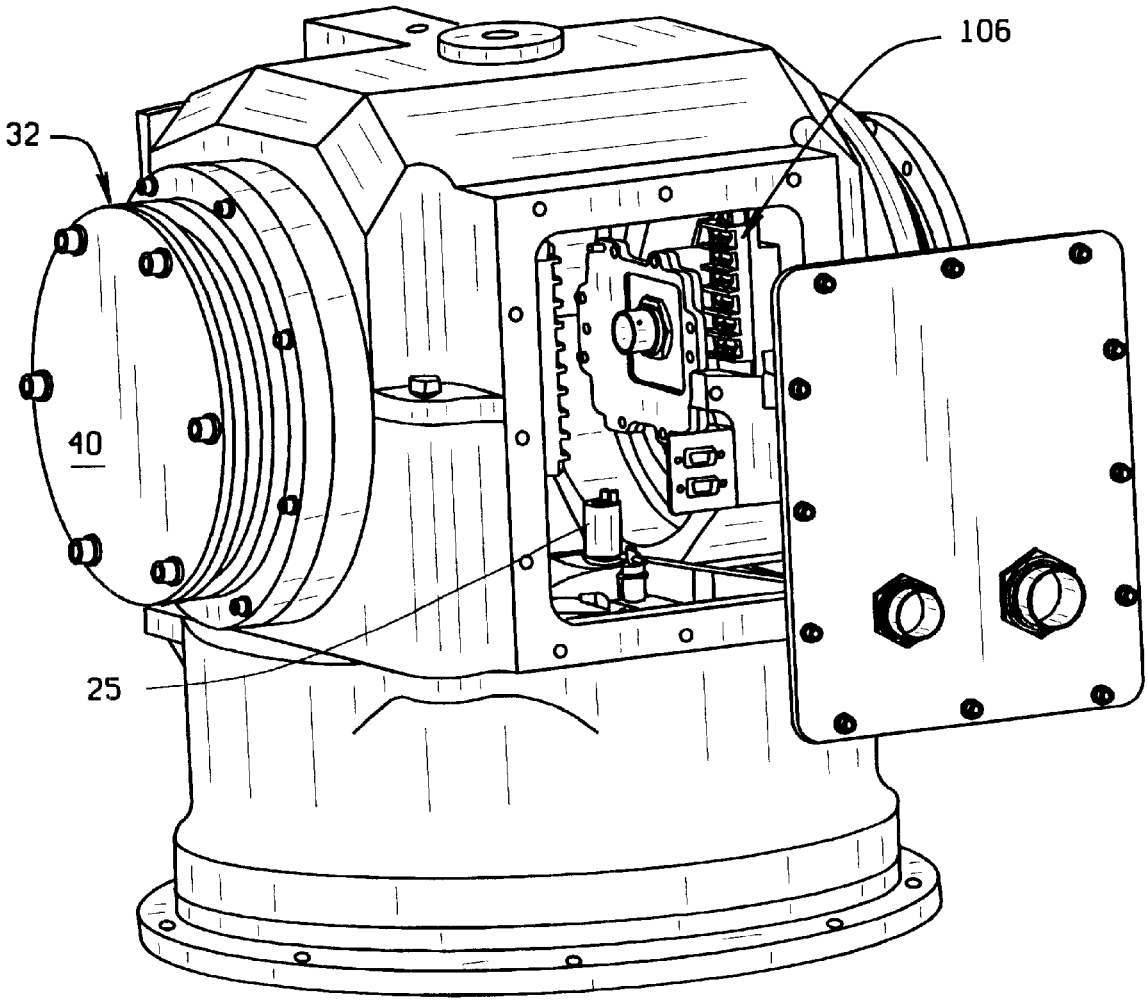
FIG. 3B is a perspective view of the housing of the stabilized common gimbal, illustrating the placement of they gyroscope assembly component.

In FIGS. 3A and 3B, GAU 106 is shown to comprise a rectangular framework 110, within which a GAU circuit board 112 and the gyroscopes 100, 102, and 104 are secured. A circuit card assembly CCA is connected to each gyroscope to provide input power conditioning for the power supplied to the gyroscope and signal conditioning to output signals provided by the gyroscope. Secured to one face of framework 110 is a face plate 114 having an input/output connector 116 for effecting required electrical connections to circuit board 112 and the gyroscopes. A cover 118 encloses the remaining sides of the framework and is secured to face plate 114 by suitable connectors such as bolts or screws to form a self-contained unit. As seen in FIG. 3B, the GAU is suitably mounted inside gimbal 32 with an electrical connector (not shown) connected to connector 116. The external dimensions of GAU 106 are limited by the interior diameter of the elevation shaft or gimbal 32 and preferably do not exceed 4 inches (10.1 cm) per side. It is also preferable that the GAU be environmentally sealed, including sealing against electromagnetic interference. The GAU is removable from elevation shaft or gimbal 32, through one end of thereof, by removal of the appropriate mounting flange 40.

Figure 4:
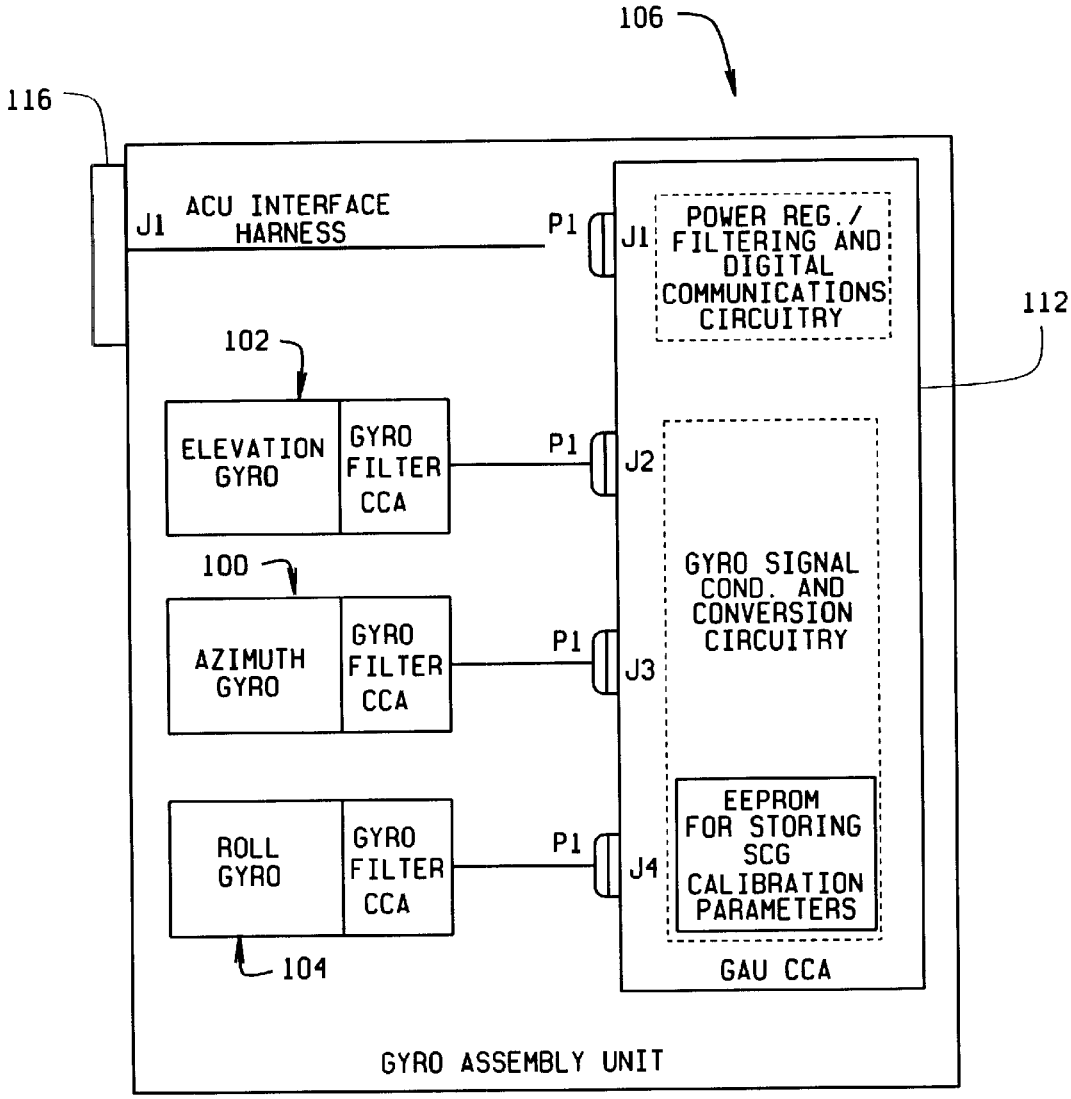
FIG. 4 is a circuit block diagram for the gyroscope assembly component.

As seen in FIG. 3A, three gyroscopes 100, 102, and 104 are mounted within framework 110 in quadrature with each other. The angles between the gyro mounting surfaces are held only to 90°±1°. A gyroscope electronic calibration software routine employed by the SCG reduces the need for expensive, accurately machined quadrature angles. Prior to installation in an SCG, each GAU is first electronically calibrated for its own manufacturing tolerances. The calibration data is stored within a non-volatile EEPROM mounted within the GAU assembly. Each of the gyroscopes 100, 102, and 104 is installed using mounting rings 111 supplied by the manufacturer. Mounting ring inspections ports (reference ports) are mounted within 1° of a sense axis (not shown) for each of the gyroscopes. This facilitates proper sensing alignment of each gyroscope during installation. Gyroscopes 100, 102, and 104 are mounted so as to have an orientation that senses the azimuth, elevation, and roll axis of SGC 10. An output from each of the gyroscopes provides a rate output signal indicative of the rate of movement about the associated axis which a respective gyroscope is sensing. Once the rate output signal is electronically scaled and filtered, it is converted and transmitted serially to ACU 108 for use in a feedback control loop designed to maintain a desired position and orientation for the SCG. All gyroscope communication, conversion and EEPROM electronics, are mounted inside GAU 106 on circuit board 112, and a suitable electrical interface harness provides for connecting circuit board 112 to ACU 108 through input/output connector 116 for communications and power. The main hardware functions of GAU circuit board 112 are shown in FIG. 4 and include power regulation and filtering of filtered MIL-STD-1275. A protected external 12 Vdc power source (not shown) provides power from the ACU, through input/output connector 116, for the gyroscope signal conditioning as described above, analog to digital conversions, EEPROM data storage, controller functions, and synchronous serial communications with ACU 108. Synchronous serial communications maintained between GAU 106 and ACU 108 are preferably RS485 compatible and the data transfer rate is up to 150 Kbps.

In the preferred embodiment, external signals supplied to input/output connector 116 of the GAU can withstand ESD environments, including an ESD pulse of up to 3999 volts (when switched from an energy source capacitance of 100 pf through a 1500 ohm resistance). ESD voltage design protection is measured from each signal to its interface circuit's relative electrical ground. Nuclear survivability design requires use of suitably hardened components. Operation of GAU 106 through a nuclear event is not required, and the GAU depends upon any external power source to have a nuclear event detector and appropriate circumventing circuitry to shut off the power to the GAU. Electromagnetic pulse survivability for the GAU is a function of the GAU's physical design and attached system cabling. This cabling is preferably double braid shielded cabling. The external interface signals are designed to withstand direct shorts to potentials from electrical ground to 30 volts for a period of up to 10 seconds. Further, GAU 106 is preferably capable of continuously operating at temperatures of −31.7° C. (−25° F.) to+51.7° C. (+160° F.).

Figure 5:
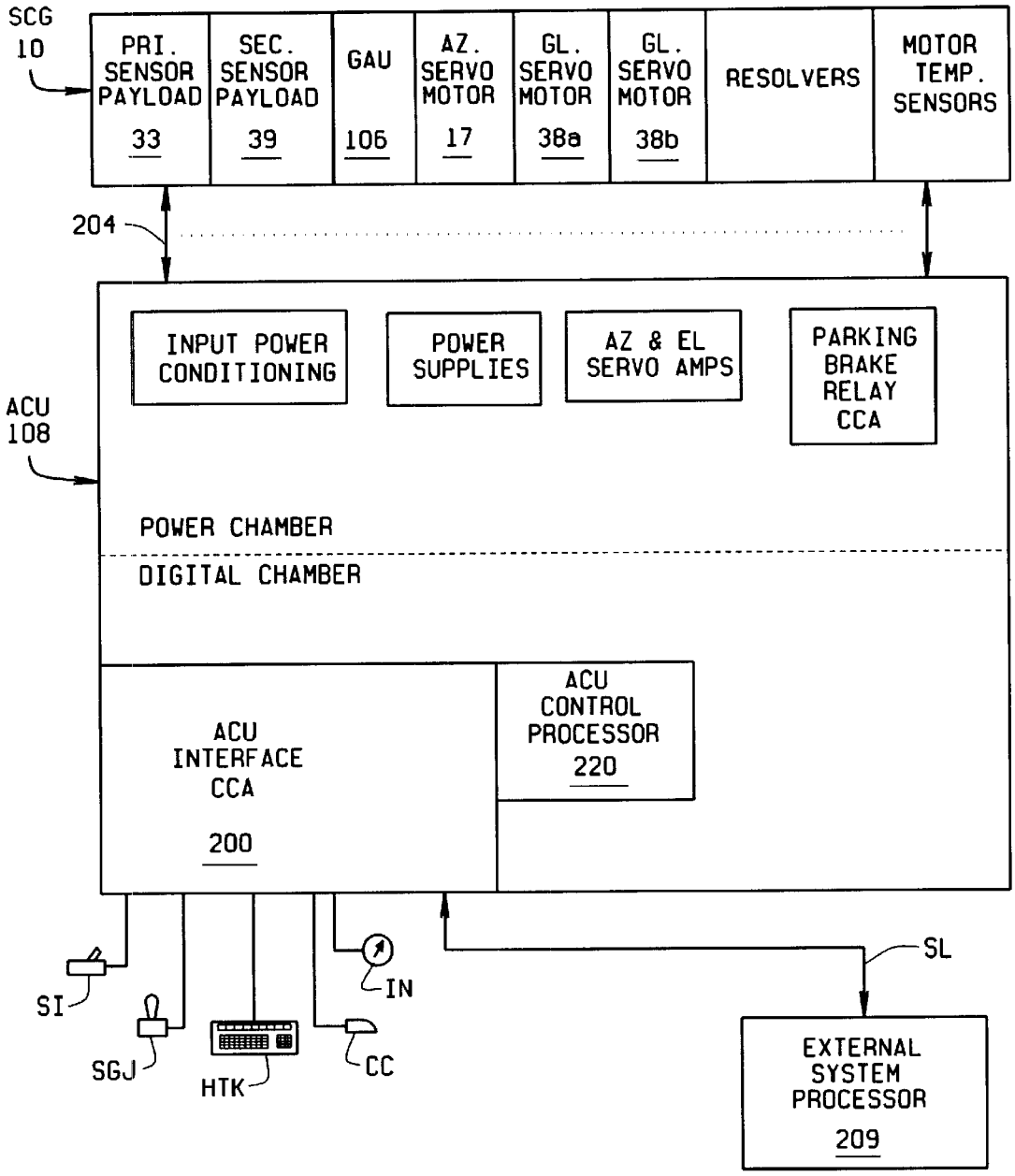
FIG. 5 is a simplified block diagram representation of axes control unit used with the stabilized common gimbal.

Gyroscope rate output signals from GAU 106 are received at ACU 108 which, as noted, contains hardware and software for controlling SCG 10, and which supplies power to the SCG. As shown in FIG. 5, ACU 108 provides an external interface between azimuth servo motor 17, elevation servo motors 38A, 38B, GAU 106, the primary and secondary sensor payloads 33, 39, up to two common control panels (CCP's) 200, and a system central processor (SCP) 202. The ACU mounts within the vehicle or structure to which SCG 10 is secured. Connections between the ACU and SCG are by shielded cables 204 routed through gimbal mount bulkhead connectors (not shown) to the appropriates systems contained within SCG 10. The SCG's motor control and drives, motor temperature sensors, GAU and resolvers are either controlled or sensed over the connecting cables 204 by the hardware contained within ACU 108. An external system processor 209 is provided with a serial link (SL) to a system central processor (SCP) 202 of ACU 108. In a remote operating mode, the ACU receives gimbal commands over the serial link. In all modes of operation, the ACU exchanges system level status and configuration information over the serial link to illuminate appropriate indicators on CCP 200. Each CCP 200 includes a strain gauge type of joystick (SGJ), an AT keyboard (ATK), a cursor control (CC) which is serial mouse capable, various discrete switch inputs (SI), and a number of indicators (IN).

Figure 6:
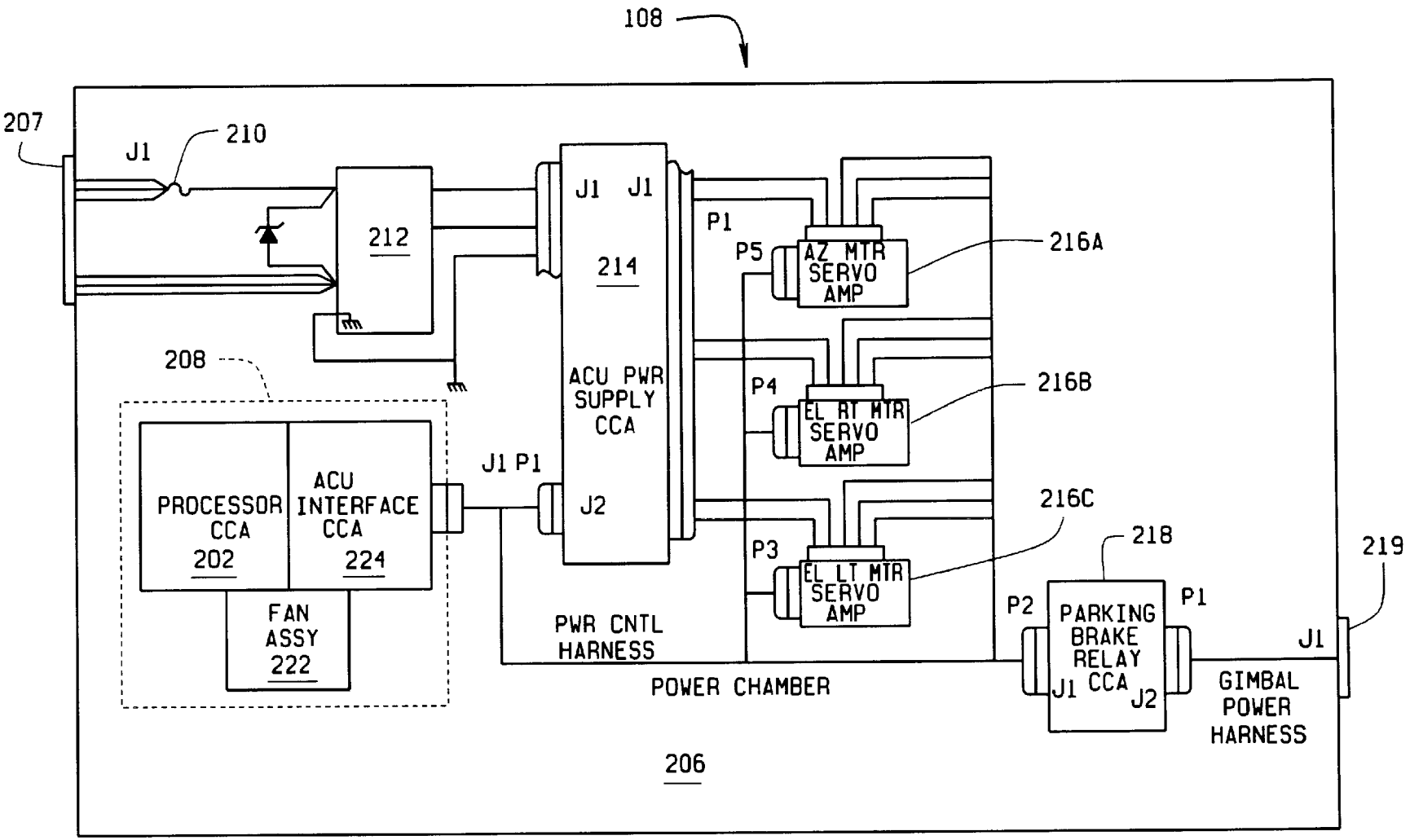
FIG. 6 is a circuit block diagram for the axes control unit.

Physically, as seen in FIG. 6, the ACU is divided into two chambers 206, 208 to reduce electromagnetic interference. ACU 108 is configured to withstand the same environmental conditions, as set forth above, for GAU 106. A power chamber 206 includes the hardware required to receive external power from an external connector 207 and to filter and distribute the power throughout SCG 10 to azimuth motor 17 and both elevation motors 38A, 38B, as well as to the primary and secondary sensor payloads 33, 39. Included in chamber 206, for power flow distribution, is a circuit breaker 210 configured to protect the ACU and SCG components against power surges or spikes from the external power source, and an EMI diode assembly and filter 212 which filters the incoming power. From filter 212, power is supplied to an ACU power supply circuit board 214, from which it is distributed to each of three servo amplifiers 261A, 261B, 216C, a parking brake relay 218, and SCP 202 through a connector 219 and associated interconnection and wiring harnesses (not shown). The azimuth and elevation servo motors 17, 38A, 38B, are each brushless three-phase motors, and each motor is powered from an associated servo amplifier 216A, 216B, 216C in the ACU. When the servo motor windings are not powered, parking brake relay 218 provides a dynamic parking brake for SCG 10 by shunting the servo motor windings.

Chamber 208 of the ACU houses all low level analog and digital signal circuitry, and this circuitry is shielded from electromagnetic interference associated with power supply 214 and servo amplifiers 261A, 261B, 216C. Installed in chamber 208 is a fan assembly 222 and associated temperature sensors so to provide cooling air circulation, an ACU Interface (AI) circuit board 224 and SCP 202. The SCP is preferably a stackable PC104 processor circuit card assembly, and the SCP communicates with AI circuit board 224 via the 16-bit PC104 bus. Additional circuit card assemblies may optionally be included on the PC104 bus in a stackable configuration if needed for future systems. External connections to the SCP are provided through AI circuit board 224 and are for a serial mouse interface, an AT keyboard interface, a VGA interface, and an 10baseT Ethernet (RJ45) interface. An additional diagnostic RS232 serial link for a remote terminal and test acquisition connector are also available on the circuit board. All system software for SCG 10 resides on SCP 202.

Additionally included on AI circuit board 224 are interfaces for CCP 200, GAU 106, and the gimbal sensors and control. The circuit board is configured to interface with azimuth resolver 25 and elevation resolver 31. The AI resolver interface circuits include all components required to excite and monitor resolvers 25, 31, and to convert resolver output data to digital data available on the PC 104 bus stack. It is preferable that the resolver data to digital conversion have an accuracy of ±2 arc minutes and be capable of tracking a resolver with an input rate of 60 degrees per second.

To facilitate monitoring of the servo motors 17, 38A and 38B, AI circuit board 224 is configured to receive signals from three motor temperature sensors (not shown) associated with the respective servo motors and the AB and BC motor phases for each servo motor. Commutation of the gimbal motors via the servo amps is provided by the ACU software and DIAs(?).

SCP 202 employs a closed loop control system having two basic states of operation. In the first state, an automated alignment is achieved by execution of a 400 Hz loop in which each pass provides an update to the control servos for azimuth motor 17 and both elevation motors 38A and 38B. In the second state, the 400 Hz loop is deactivated, and operator input for diagnostics, or the changing of control servo parameters via CCP 200, is provided. When primary sensor payload 33 is being positioned, the control loop is closed on either the azimuth and elevation resolvers 25, 31 (for position control) or on gyros 100, 102, 104 (for rate control). Position control is used for stowing the primary sensor payload, i.e. for moving the payload to a predetermined stow location. External position commands may be received from an operator via CCP 200 or from the system communication links. Rate control is a normal, stabilized control mode in which the operator uses the joystick, or a remote input command over the serial link, to point the primary sensor payload. When no operator input commands are received, the control loop regulates the primary sensor payload inertial orientation to remain in a fixed position and attitude.

Upon receipt and recognition of a 400 Hz interrupt signal, control of the system is passed to the 400 Hz control loop software, which responds to operator input settings, switch states, and EEPROM contents to perform the following functions:

Watchdog Timer Strobe

Read Analog Inputs

Read Elevation and Azimuth Resolvers and Check for Travel Limits

Sense Switch States

Determine System Mode

Set Up Control Parameters and Perform Servo Functions

Send Out Data to be Logged

Route Instrument Outputs to the Digital to Analog Outputs

Figure 7:
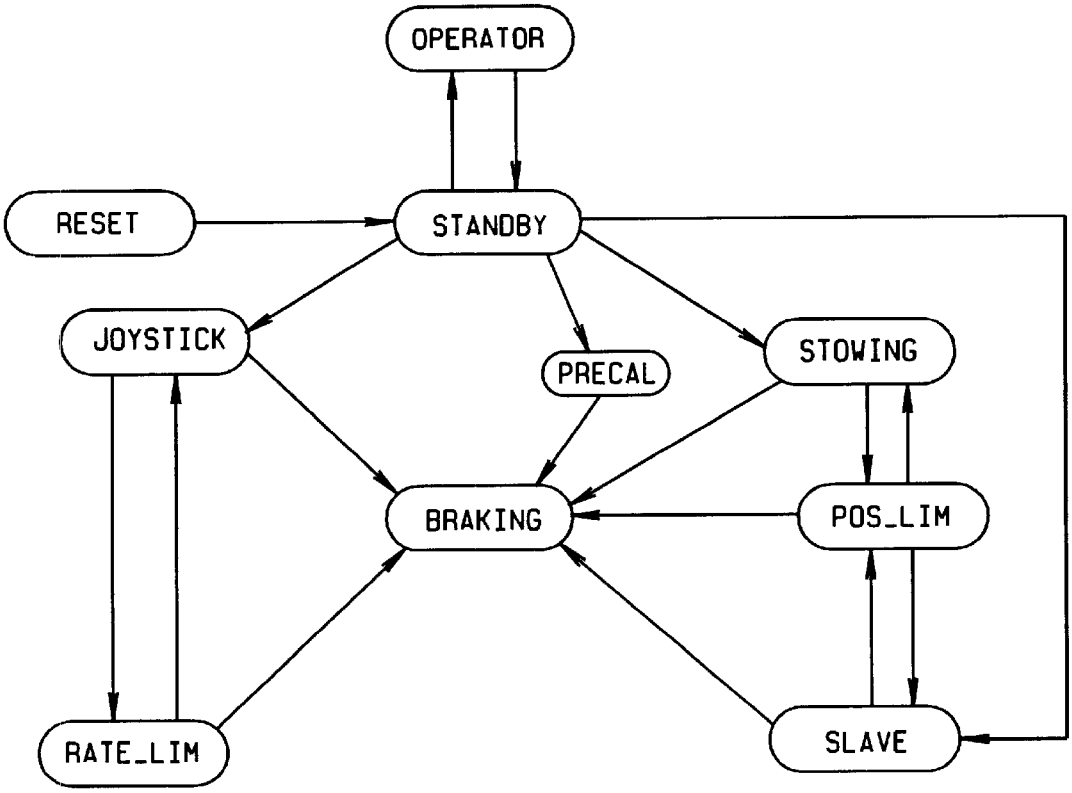
FIG. 7 is a state diagram of the operating states for the control system for the stabilized common gimbal of the present invention.

In FIG. 7, system modes and permissible transitions between system modes for the 400 Hz control loop software is illustrated. Upon system power-up or a power reset, the 400 Hz control loop software initializes in a RESET state. The functions performed in this state include hardware and software initialization and power-up tests dependent upon the specific ACU architecture. From the RESET state, the 400 Hz control loop software transitions to a STANDBY state where servo states are set to zero. The system now awaits either a servo action or the entry of an operator command. From the STANDBY state, the 400 Hz control loop software may transition into one of several states, an OPERATOR state, a JOYSTICK state, a pre-calibration or PRECAL state, a STOWING state, or a SLAVE state. If the transition is from the STANDBY state to the OPERATOR state, no transitional actions are performed by the 400 Hz control loop. When the transition from the STANDBY state is to either the JOYSTICK or PRECAL states, the control loop identifies rate servo parameters, enables the drive and servos, and releases the brakes on the stabilized common gimbal. Transition is then completed after a 400 ms wait. If the 400 Hz control loop detects that the position or orientation of the primary sensor package is within a range of restricted motion zones during a transition from the STANDBY state to the JOYSTICK state, the control loop automatically transitions to a restricted motion sub-state of the JOYSTICK state, described in further detail below. During a transition from the STANDBY state to the STOWING state, the control loop identifies position servo parameters, again enables the drive and servos, releases the brakes on the stabilized common gimbal, and waits 400 ms before completing the state transition.

The OPERATOR state is an interactive mode which allows the operator of the system to enter data related to the servo operation, initiate diagnostics, or "peek and poke" memory operations. When in the OPERATOR state, the servos are deactivated, and only a "watchdog" timer reset remains enabled.

In the JOYSTICK state, the 400 Hz control loop operates to follow operator input commands and control the primary sensor payload 33 position and orientation via joystick SGJ. In the preferred embodiment, position and orientation changes are limited to movements within a speed range of 60° per second. To make joystick control smoother, joystick input commands have an acceleration limit. This allows a 60° per second maximum rate to be achieved in a smooth manner, for slewing purposes, while providing adequate sensitivity for target tracking at slower rates of change. A preferred acceleration limit on the joystick input signal is established as a function of the force applied to the joystick.

The only permissible state changes form the JOYSTICK state are to and from a rate limit or RATE_LIM state, or to a BRAKING state. Transitions between the JOYSTICK state and the RATE_LIM state immediately occur when movement of primary sensor payload 33 into a restricted motion zone is detected; and, the restricted motion sub-state of the JOYSTICK state described below is not the current state. During transitions to the BRAKING state from the JOYSTICK state, a preferred timeout of 0.4 seconds is established for stopping all motion of the primary sensor 33 payload, and the brake servo parameters are identified.

The RATE_LIM state is automatically entered from the JOYSTICK state when the restricted motion zone is entered by the primary sensor payload 33 position and orientation.

In this mode, rate commands are limited to avoid violating physical travel limits of the primary sensor payload as defined by the SCG. Once the primary sensor payload position and orientation is again outside the restricted motion zone, the 400 Hz control loop returns to the JOYSTICK state, or may enter the BRAKING state.

An additional joystick control state is provided by the PRECAL state. In this state, the 400 Hz control loop limits joystick rate commands, providing a limited capability to drive primary sensor 33 payload position and orientation prior to calibration of the system. This prevents extensive manual positioning and the associated exposure of crew or operators to dangerous environments prior to setting travel limits, etc. Joystick movement rates are limited such that they are not likely to result in damage to the system if primary sensor 33 payload is accidentally directed to a position or orientation outside the operational range of movement. The only permissible state change from the PRECAL state is to the BRAKING state.

During periods of non-use, it is often desirable to have primary sensor 33 payload parked in a predetermined storage position. Accordingly, the STOWING state is used to direct the primary sensor payload to a previously designated position and orientation with respect to the vehicle; for example, a zero elevation and zero longitudinal alignment. If a stow position has not been previously defined, the default position and orientation is the zero-zero attitude. From the STOWING state, the system may transition either into the BRAKING state, or immediately to the POS_LIM state. The latter occurs upon detection of motion of the primary sensor payload into a restricted motion zone. Again, the 0.4 second timeout is used to stop all motion of primary sensor 33 payload, and to identify brake servo parameters.

In addition to being controlled by operator input commands when in the JOYSTICK state, primary sensor 33 payload position and orientation may be driven in response to external position commands when the 400 Hz control loop is in the SLAVE state. These external commands are limited to the restricted travel limits, and are not applicable when the travel limits are exceeded or if a restricted motion zone of movement is entered. In the preferred embodiment, the SLAVE state is utilized to slew the primary sensor payload to a specific radar location. From the SLAVE state, the control loop can transition either directly to the POS_LIM state, upon detecting primary sensor 33 payload movement into a restricted motion zone; or directly to the BRAKING state. The timeout features previously described apply to this transition as well.

The POS_LIM state is automatically entered by the control loop from either the STOWING or SLAVE states when a restricted motion zone is entered by the position and orientation of primary sensor 33 payload. While in this state, rate commands generated from position error information are limited so to avoid violating absolute travel limits of the primary sensor payload. From the POS_LIM state, the control loop may go directly to the STOWING or SLAVE states without performing any transitional actions, or may transition to the BRAKING state. During transition to the BRAKING state from the POS_LIM state, the preferred timeout is again observed for the reasons previously discussed.

The BRAKING state is entered when the operator releases an action switch SI, physical travel limits for primary sensor 33 payload are violated, or when an abnormal condition warranting servo shutdown occurs. The BRAKING state consists of two phases; first, stopping the primary sensor payload motion, and second, disabling the servos and drive units. During normal operation, the hardware itself initiates a shutdown sequence within a fixed period of time.

Three sub-states present within the control loop software are not shown in FIG. 7. The first, TRANSITIONING_UP is a sub-state of the STANDBY state, and is active when all conditions are met to transition to the JOYSTICK, STOWING, or SLAVE states, but a waiting period is entered while servo hardware is performing startup sequences to support active control of gimbal 32. The second sub-state, TRANSITIONING_DN is a sub-state of the BRAKING state, and is active when all conditions are met to transition to STANDBY, but a delay is required while the servo hardware is performing shutdown sequences to enter the STANDBY state. The third sub-state is a JOY_DEGRADED state which is a sub-state of the JOYSTICK state. This sub-state limits commands to only those which direct primary sensor 33 payload to move away from its travel limits shown into a region of unconstrained motion.

Finally, a data logging function is called for by the 400 Hz control loop software on every pass through the 400 Hz processing task, unless the control loop is in the OPERATOR state. Logged data is sent out every pass, so that the resulting data rate is thus 400 Hz.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A two axes stabilized common gimbal (SCG) installed on a vehicle comprising:

a platform on which a primary suite of sensors is commonly mounted, the primary suite of sensors including one or more sensors chosen from a plurality of sensors any of which are accommodated on the platform without requiring modification of the platform, the sensors being stabilized on the platform, and movement of the platform being independent of the two axes;

first and second gyroscopes, one for azimuth and one for elevation, the gyroscopes providing intertial gimbal rates to control movement of the sensor suite and stabilization of the platform;

calibration means for executing an automatic calibration procedure so to orient the platform for the sensors comprising the suite to have a common line-of-sight when thereafter in use; and, a third (roll) gyroscope for use in executing the automatic electronic calibration procedure, whereby the platform is stabilized against vehicle motion in both azimuth and elevation.

2. The stabilized common gimbal of claim 1 further including an inertial navigation system providing navigation for the vehicle, the inertial navigation system detecting the line-of-sight of the primary suite of sensors with the line-of-sight of the suite being remotely determined.

3. The stabilized common gimbal of claim 1 which is not vehicle or platform dependent and can stabilize any primary suite of sensors specified within weight and distribution limits of the gimbal.

4. The stabilized common gimbal of claim 1 further including a secondary suite of sensors comprising one or more sensors commonly mounted on a second and separate platform from the first said platform, the sensors comprising the secondary suite operating independently of the two axes of the gimbal and the line-of-sight of the primary suite of sensors.

5. The stabilized common gimbal of claim 1 which can be operated remotely over a serial link through which commands originating from another device, including a radio link or tracker, are transmitted to the gimbal.

6. The stabilized common gimbal of claim 4 which is capable of taking sensor data from the secondary suite of sensors and moving the primary suite of sensors to a line-of-sight dictated by sensor data to assist in shorter range identification of an object using the primary suite of sensors.

7. The stabilized common gimbal of claim 1 further including a gyroscope assembly unit in which the respective gyroscopes are installed, the gyroscopes being mounted orthogonally to each other within the unit.

8. The stabilized common gimbal of claim 7 wherein the calibration means automatically couples the gyroscopes and includes a gyroscope calibration algorithm by which machining inaccuracies in fabricating the gyroscope assembly unit are removed thereby making the gyroscope assembly unit economical to produce.

9. The stabilized common gimbal of claim 1 in which the platform includes first and second pods located on opposite sides of the platform, sensors comprising the primary suite of sensors being installed in each pod.

10. The stabilized common gimbal of claim 9 in which the first and second pods differ in size and shape from each other.

11. The stabilized common gimbal of claim 10 wherein the platform includes a housing in which the gimbal is installed.

12. The stabilized common gimbal of claim 11 further including a gyroscope assembly unit in which the respective gyroscopes are installed, the unit being installed within the housing.

13. The stabilized common gimbal of claim 12 further including separate motors for moving the platform in each axis of its rotation.

14. The stabilized common gimbal of claim 1 further including a closed loop control system for automatically aligning the primary suite of sensors with the line-of-sight.

15. The stabilized common gimbal of claim 14 in which the gyroscopes provide rate control information to the control system and the gimbal further includes a resolver for each axis to provide position control information to the control system.

* * * * *